US008286961B2

(12) United States Patent
Kanamoto

(10) Patent No.: US 8,286,961 B2
(45) Date of Patent: Oct. 16, 2012

(54) IMAGE FORMING APPARATUS AND METHOD OF CONTROLLING THE SAME

(75) Inventor: Yoshiji Kanamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/777,335

(22) Filed: May 11, 2010

(65) Prior Publication Data

US 2010/0295235 A1 Nov. 25, 2010

(30) Foreign Application Priority Data

May 25, 2009 (JP) ..... 2009-125847

(51) Int. Cl.
*B65H 3/44* (2006.01)
*B65H 5/26* (2006.01)

(52) U.S. Cl. ..... 271/9.02; 271/9.01; 271/9.03; 271/9.04

(58) Field of Classification Search ..... 271/9.01–9.04
See application file for complete search history.

(56) References Cited

U.S. PATENT DOCUMENTS 4,763,889 A * 8/1988 Dei et al. ..... 271/9.03
5,028,041 A * 7/1991 Kobayashi ..... 271/9.03
6,487,379 B2 * 11/2002 Sato ..... 399/16
7,480,467 B2 * 1/2009 Ueki et al. ..... 399/23
7,843,584 B2 * 11/2010 Nishikata et al. ..... 358/1.15
2008/0290583 A1 * 11/2008 Kubo et al. ..... 271/9.01
2009/0166949 A1 * 7/2009 Unno ..... 271/9.03
2009/0184456 A1 * 7/2009 Nishii ..... 271/9.01
2009/0218747 A1 * 9/2009 Mutsuno ..... 271/3.14

FOREIGN PATENT DOCUMENTS

JP 2001-302003 10/2001

* cited by examiner

*Primary Examiner* — Kaitlin Joerger

(74) *Attorney, Agent, or Firm* — Fitzpatrick, Cella, Harper & Scinto

(57) ABSTRACT

When image formation processing is in progress using sheets stacked on a given stacking unit and sheets are supplied to another stacking unit, image formation processing continues using the sheets stacked on the other stacking unit. To accomplish this, at the timing when the closing of a feeding source is detected, a control unit (205) determines in step S1001 whether a printer (1000) is executing print processing. In step S1002, the control unit (205) displays a display screen (611) serving as a feeding source selection screen on an operation unit (204). In step S1005, the control unit (205) executes switching processing to the feeding source selected via the display screen (611).

13 Claims, 12 Drawing Sheets

IMAGE FORMING APPARATUS AND METHOD OF CONTROLLING THE SAME

BACKGROUND OF THE INVENTION

1. Field of the Invention

The present invention relates to an image forming apparatus and a method of controlling the same.

2. Description of the Related Art

Japanese Patent Laid-Open No. 2001-302003 discloses an image forming apparatus having a plurality of stacking unit. This reference discloses a method of, when sheets run out while executing image formation processing using sheets stacked on a given stacking unit, continuing the image formation processing using sheets stacked on another stacking unit.

However, the conventional technique suffers the following problem. Assume that image formation processing is in progress using sheets stacked on a given stacking unit. At this time, even if the user supplies sheets on another stacking unit and wants to continue the image formation processing using the sheets supplied by him, the stacking unit used in the ongoing image formation processing is kept used.

SUMMARY OF THE INVENTION

The present invention enables realization of, during image formation processing using sheets stacked on a given stacking unit when sheets are supplied to another stacking unit, continuing the image formation processing using the sheets stacked on the other stacking unit.

One aspect of the present invention provides an image forming apparatus comprising: a plurality of stacking units on which sheets are stacked; an image forming unit that executes image formation processing using sheets stacked on any one of the plurality of stacking units; a control unit that controls the image forming unit to execute the image formation processing using sheets stacked on a first stacking unit; a detection unit that detects that sheets have been supplied to a second stacking unit that is different from the first stacking unit; and a selecting unit that selects, in case that the detection unit detects that sheets have been supplied to the second stacking unit when the image forming unit is executing the image formation processing using sheets stacked on the first stacking unit, a third stacking unit that is to be used for continuing the image formation processing, in accordance with user's instruction, wherein the control unit controls, in case that the selecting unit selects the third stacking unit, the image forming unit to continue the image formation processing that is being executed by using the sheets stacked on the first stacking unit, by using sheets stacked on the third stacking unit.

Another aspect of the present invention provides a method of controlling an image forming apparatus including a plurality of stacking units on which sheets are stacked, and an image forming unit that executes image formation processing using sheets stacked on any one of the plurality of stacking units, the method comprising: causing a control unit to control the image forming unit to execute the image formation processing using sheets stacked on a first stacking unit; causing a detection unit to detect that sheets have been supplied to a second stacking unit that is different from the first stacking unit; and causing a selecting unit to select, in case that the detection unit detects that sheets have been supplied to the second stacking unit when the image forming unit is executing the image formation processing using sheets stacked on the first stacking unit, a third stacking unit that is to be used for continuing the image formation processing, in accordance with user's instruction, causing the control unit to control, in case that the selecting unit selects the third stacking unit, the image forming unit to continue the image formation processing that is being executed by using the sheets stacked on the first stacking unit, by using sheets stacked on the third stacking unit.

Further features of the present invention will be apparent from the following description of exemplary embodiments with reference to the attached drawings.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<First Embodiment>

<Configuration of Printing System>

Figure 1:
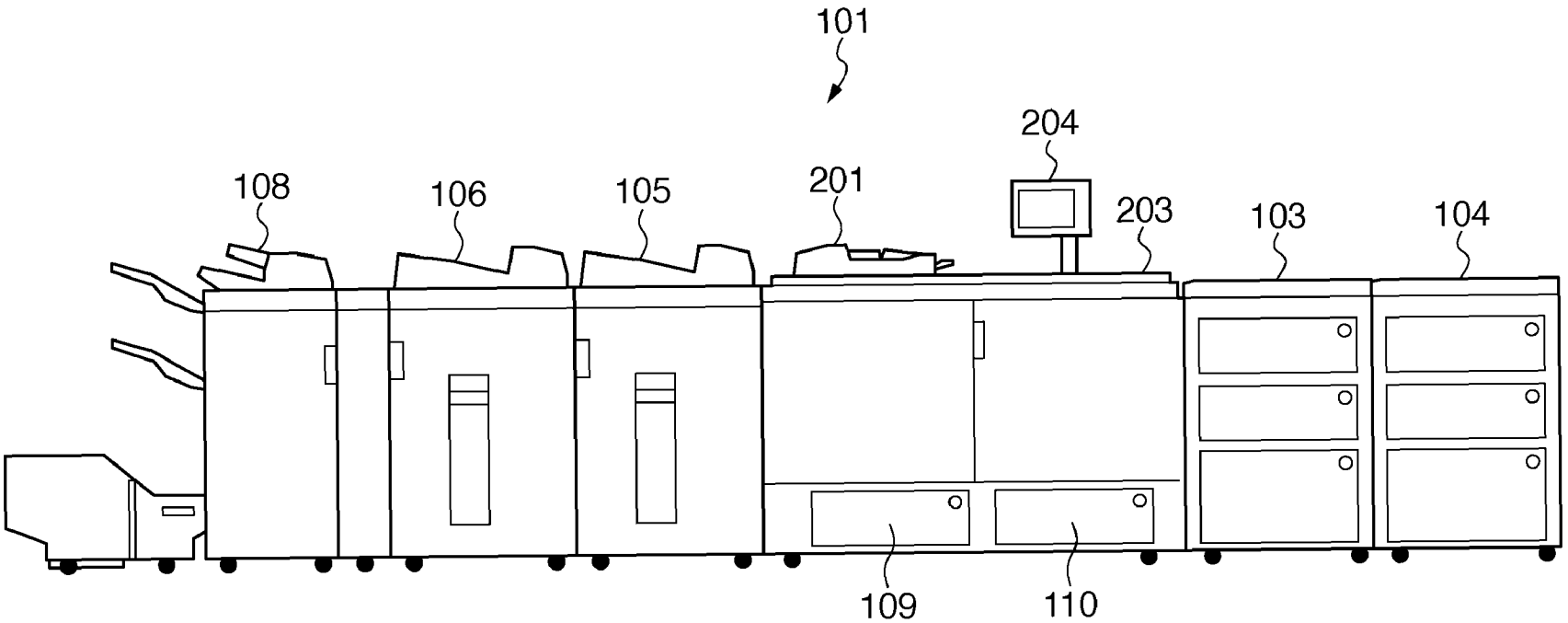
FIG. 1 is a view showing the schematic configuration of a printing system 101 according to the first embodiment.

The first embodiment will be described with reference to FIGS. 1 to 10. FIG. 1 is a view showing the schematic configuration of a printing system 101 according to the first embodiment. The printing system (image forming system) 101 is an example of connecting sheet processing devices (to be described later) to a digital printing apparatus directed to the POD market. As shown in FIG. 1, in the printing system 101, sheet processing devices having different roles are coupled to each other and can execute complicated sheet processing.

A printer unit 203 executes image formation processing to form an image on a sheet with a toner based on rasterized image data. A sheet on which the printer unit 203 forms an image will also be called a sheet material, paper, and the like. More specifically, a beam such as a laser beam modulated in accordance with image data enters a rotating polyhedral mirror (polygon mirror) or the like and irradiates a photosensitive drum as a reflected scan beam via a reflecting mirror. A latent image formed on the photosensitive drum by the laser beam is developed with toner. The toner image is transferred onto a sheet material on the photosensitive drum. The series of image forming processes is executed sequentially with yellow (Y), magenta (M), cyan (C), and black (K) toners, thereby forming a full-color image. The sheet material bearing the image on the transferred drum is conveyed to a fixing unit. The fixing unit is formed from a combination of rollers and a belt, and incorporates a heat source such as a halogen heater. By heat and pressure, the fixing unit fuses and fixes the toner on the sheet material bearing the toner image.

Note that the printer unit 203 of the printing system 101 includes a scanner unit 201 and operation unit 204. The operation unit 204 provides various interfaces used when, for example, the operator makes various settings of the printing system 101 or manipulates the printing system 101.

As shown in FIG. 1, the printing system 101 allows attaching a variety of additional devices to the printer unit 203. The additional devices include, for example, large-volume feeding devices 103 and 104, large-volume stackers 105 and 106, and a saddle-stitching device 108. The large-volume feeding (stacking) devices 103 and 104 are detachable from the main body. As shown in FIG. 1, a plurality of large-volume feeding devices 103 and 104 are mountable. Details of the large-volume feeding device will be described later. With the large-volume feeding devices 103 and 104 and a plurality of feeding sources 109 and 110 functioning as the first and second stacking unit, print processing can be done by the total number of stackable sheets. That is, even when sheets are successively output by a high-speed engine, the frequency at which execution of a job is interrupted owing to the runout of sheets can be reduced, increasing the device use efficiency and productivity. When sheets run out, the feeding source is switched. Further, when a single feeding source is selected in execution of a job, it can also be controlled to preferentially select a feeding source with which the sheet conveyance path becomes shortest when a sheet passes through the path. This can increase the throughput in printing.

The large-volume stackers 105 and 106 are used to internally stock printed sheets output in large volume. A device equipped with a large-volume feeding device generates a large volume of output materials and thus requires a large-volume stacker. In the configuration shown in FIG. 1 according to the embodiment, the two large-volume stackers 105 and 106 are connected.

The saddle-stitching device 108 includes various kinds of units capable of selectively executing stapling, cutting, punching, folding, shift delivery, or the like for sheets from the printer unit 203.

The printing system 101 can be roughly divided into three parts at the boundaries of the printer unit 203. Devices arranged on the right side of the printer unit 203 in FIG. 1 are called feeding system devices. The main role of the feeding system device is to successively supply sheets loaded in it to the printer unit at appropriate timings. The feeding system device also detects the remaining amount of internally loaded sheets. The printer unit 203 also incorporates the feeding sources 109 and 110, which can execute the same functions as those of the feeding system device. These feeding sources of the printer unit 203 will also be called feeding system devices for descriptive convenience.

Devices arranged on the left side of the printer unit 203 in FIG. 1 are called sheet processing devices. The sheet processing devices execute various processes and stacking processing for sheets having undergone print processing. In the following description, both the foregoing feeding system devices and sheet processing devices will be called sheet processing devices.

<Control Configuration>

Figure 2:
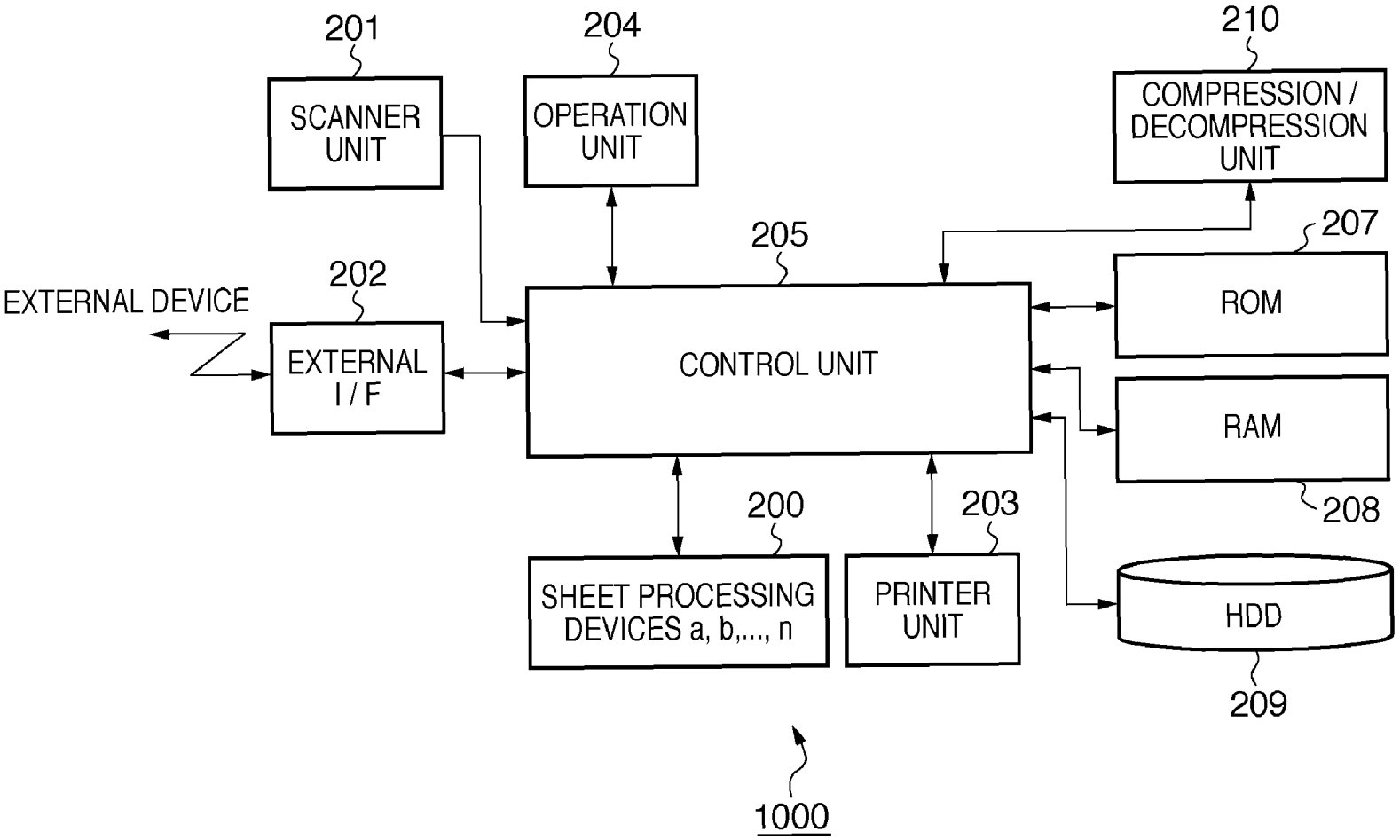
FIG. 2 is a block diagram exemplifying the control configuration of the printing system 101 according to the first embodiment.

A control configuration in the digital printing apparatus of the printing system 101 in the first embodiment will be explained with reference to FIG. 2. FIG. 2 is a block diagram exemplifying the control configuration of the printing system 101 according to the first embodiment. The digital printing apparatus includes the printer unit 203, scanner unit 201, operation unit 204, and feeding sources 109 and 110 shown in FIG. 1. The digital printing apparatus will be called a printer 1000.

The printer 1000 includes the scanner unit 201, an external I/F 202, the printer unit 203, the operation unit 204, a control unit 205, a ROM (Read Only Memory) 207, a RAM (Random Access Memory) 208, an HDD (Hard Disk Drive) 209, and a compression/decompression unit 210. The printer 1000 has a copy function using the printer unit 203 to print job data accepted from the scanner unit 201, and a print function using the printer unit 203 to print job data accepted from an external device via the external I/F 202. The printer 1000 is an MFP type image forming apparatus having such functions. Note that the printer 1000 according to the present invention is arbitrarily a printing apparatus capable of color printing or a printing apparatus capable of monochrome printing as long as it can execute various control operations to be described in the embodiment.

The scanner unit 201 scans a document image and performs image processing for the scanned image data. The external I/F 202 transmits/receives image data to/from a facsimile machine, network-connected device, or external dedicated device. The HDD 209 is a nonvolatile memory which stores a plurality of image data to be printed that are accepted from either the scanner unit 201 or external I/F 202. The operation unit 204 is used as a user interface and includes a display unit for presenting information to the user.

The control unit (also called a CPU) 205 comprehensively controls the processes, operations, and the like of various units in the printer 1000. The ROM 207 stores a variety of control programs including those for executing various processes of flowcharts to be described later. The ROM 207 stores a display control program for displaying a user interface screen (to be referred to as a UI screen) on the display unit of the operation unit 204.

The control unit 205 controls the printing apparatus to execute various kinds of operations by reading out a program from the ROM 207 and executing it. The ROM 207 also stores, for example, a program for executing an operation to interpret PDL (Page Description Language) code data received from an external device (not shown) via the external I/F 202 and rasterize it into raster image data (bitmap image data). These programs are processed by software.

The ROM 207 stores in advance a variety of programs such as programs for a boot sequence and font information, and the above-described programs. Details of the programs stored in the ROM 207 will be described later. The RAM 208 stores image data, various programs, and setting information sent from the scanner unit 201 and external I/F 202.

The HDD 209 is a large-capacity storage device which stores image data compressed by the compression/decompression unit 210. The HDD 209 holds a plurality of data such as print data of a job to be processed. The control unit 205 controls the printer unit 203 to be able to print, via the HDD 209, data of a target job input from various kinds of input units such as the scanner unit 201 and external I/F 202. The control unit 205 controls to transmit the data to an external device via the external I/F 202. In this way, the control unit 205 controls to enable various output processes for data of a target job stored in the HDD 209.

The compression/decompression unit 210 compresses/decompresses image data stored in the RAM 208 and HDD 209 in accordance with various compression methods such as JBIG and JPEG. The control unit 205 also controls the operation of each sheet processing device 200 in the printing system 101.

<Arrangement of Large-Volume Feeding Device>

Figure 3:
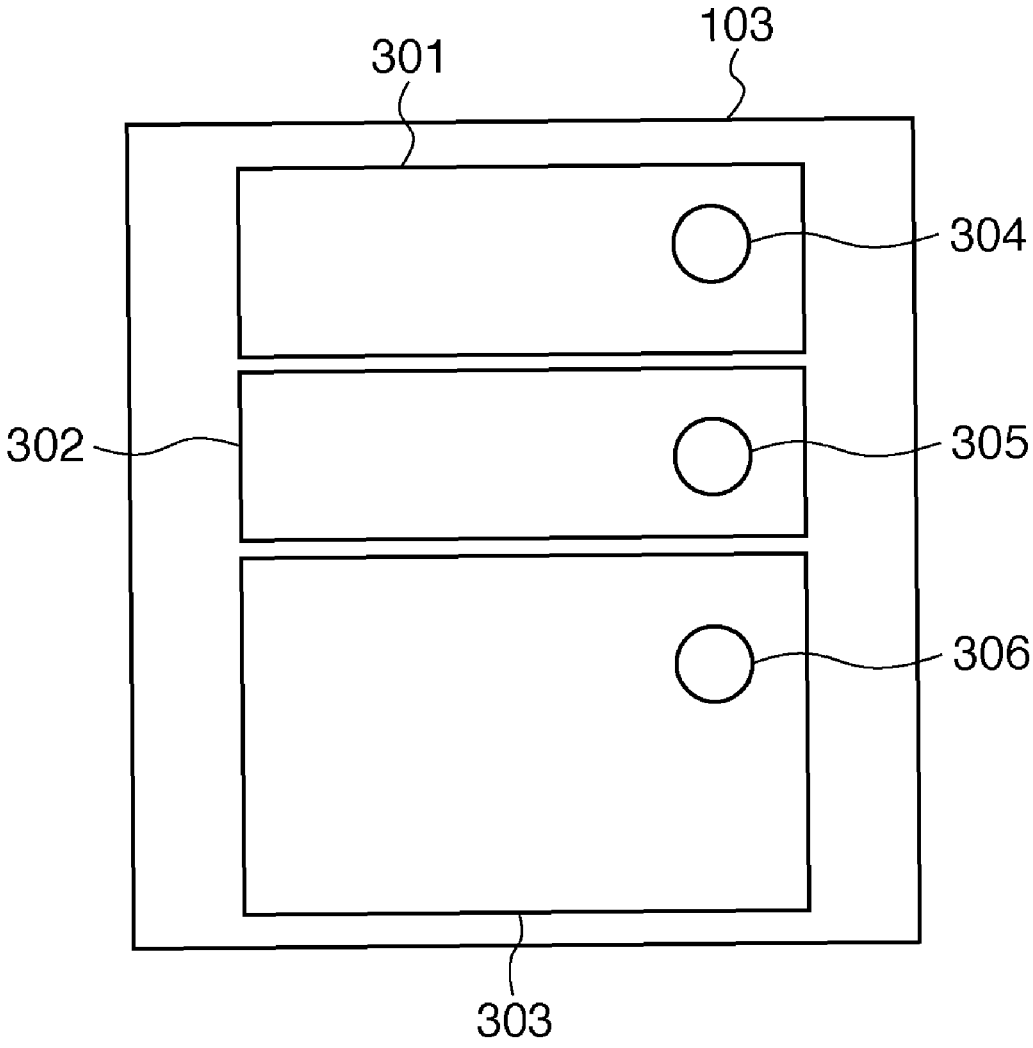
FIG. 3 is a view exemplifying the arrangement of a large-volume feeding device 103 according to the first embodiment.

The large-volume feeding (stacking) device in the first embodiment will be explained with reference to FIG. 3. FIG. 3 is a view exemplifying the arrangement of the large-volume feeding (stacking) device 103 according to the first embodiment. Although the large-volume feeding device 103 will be explained, the large-volume feeding device 104 also has the same arrangement.

As shown in FIG. 3, the large-volume feeding device 103 includes a plurality of feeding sources 301, 302, and 303. Sheets of different types or different sizes are stacked on the feeding sources 301 to 303, respectively.

The feeding sources 301, 302, and 303 are equipped with feeding source open buttons 304, 305, and 306, respectively. When the operator presses any one of the feeding source open buttons 304 to 306, the control unit 205 is notified of the trigger and controls to open a corresponding feeding source. This is because a sheet separation device running during a conveyance operation needs to be stopped. For this purpose, the opening/closing mechanisms of the feeding sources 301 to 303 are formed from mechanical lock mechanisms for physically pulling out the feeding sources 301 to 303, and electrical switches.

When the operator presses any one of the feeding source open buttons 304, 305, and 306, a corresponding feeding source is opened, and he can supply sheets. After the completion of the supply work, the operator pushes the door to the original position. Then, a close sensor (not shown) attached to each feeding source detects the completion of closing and notifies the control unit 205 of it. That is, the supply of sheets to the feeding source is detected in response to closing the door.

The feeding source 303 allows stacking a larger number of sheets than those on the feeding sources 301 and 302. The doors of the feeding sources are different in size owing to the difference in maximum capacity of internally loadable sheets, as shown in FIG. 3. When these feeding sources need to be discriminated, the feeding sources 301 and 302 will be called normal-volume feeding sources, and the feeding source 303 will be called a large-volume feeding source.

<Arrangement of Operation Unit>

Figure 4:
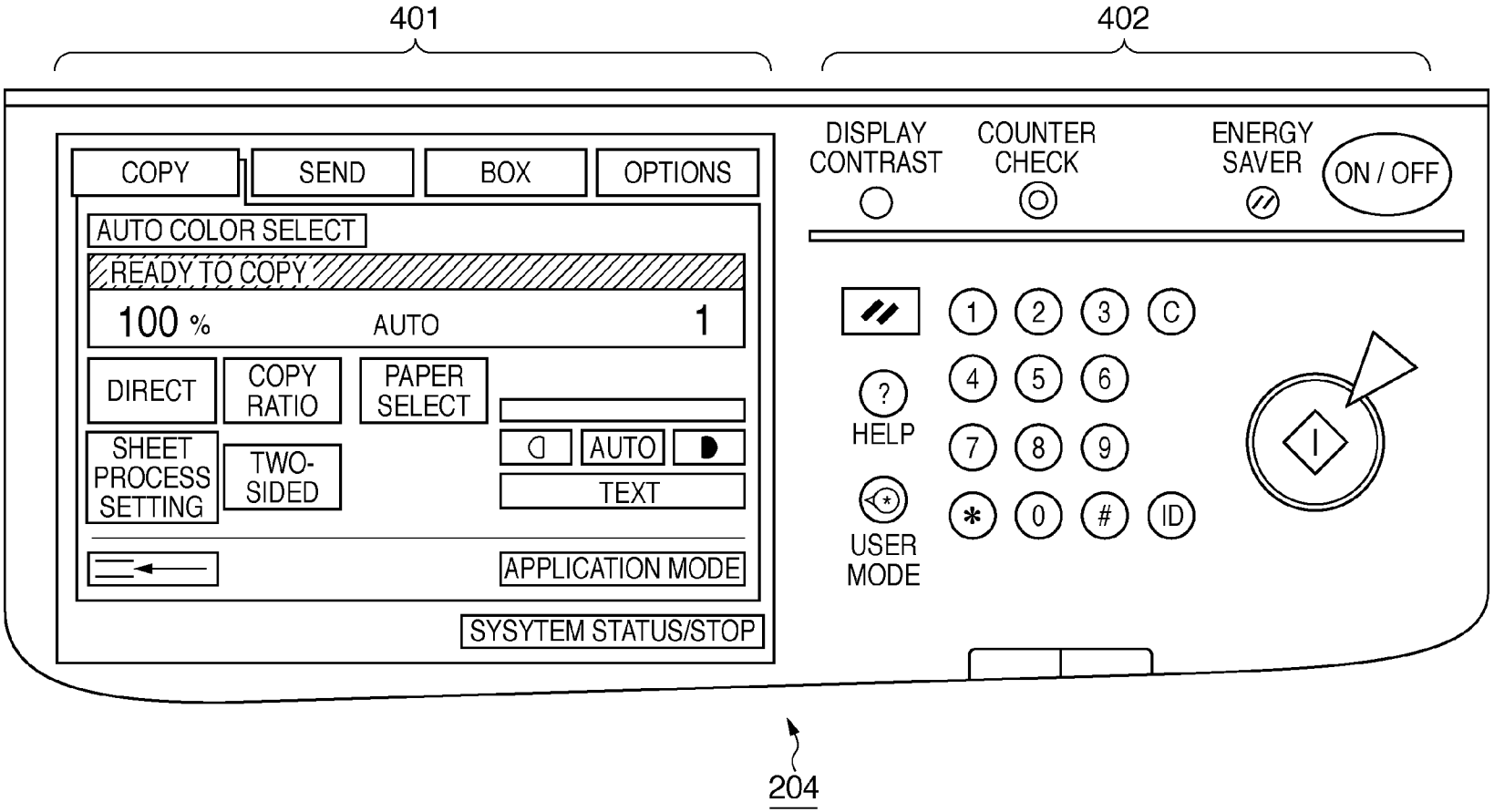
FIG. 4 is a view exemplifying an operation unit 204 according to the first embodiment.

The operation unit 204 of the printer 1000 will be described with reference to FIG. 4. FIG. 4 is a view exemplifying the operation unit 204 according to the first embodiment.

The operation unit 204 includes a key input portion 402 capable of accepting a user manipulation with hard keys, and a touch panel portion 401 serving as a display unit capable of accepting a user manipulation with soft keys (display keys).

Note that the display contents of the touch panel portion 401 in FIG. 4 are an example of various display screens, display of which is controlled by the control unit 205. The display contents change depending on a manipulation by the user (operation) or various device states.

<Control Program>

Figure 5:
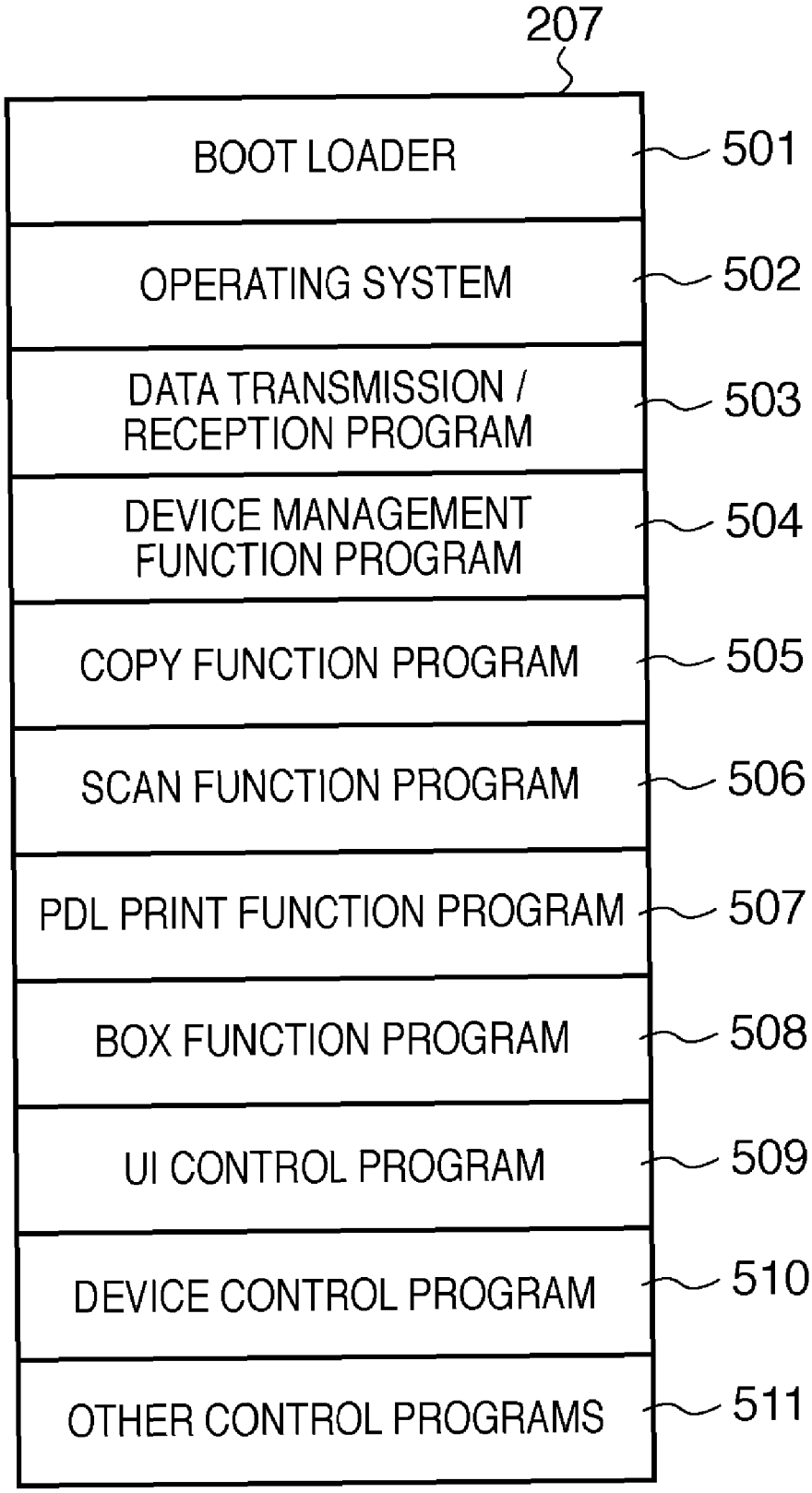
FIG. 5 is a view exemplifying control programs stored in a ROM 207 according to the first embodiment.

Various control programs stored in the ROM 207 will be explained with reference to FIG. 5. FIG. 5 is a view exemplifying control programs stored in the ROM 207 according to the first embodiment. The control unit 205 reads out and executes these control programs.

A boot loader 501 is executed immediately after turning on the printer 1000. The boot loader 501 includes a program for executing various boot sequences necessary to start up the system. An operating system 502 provides an execution environment for a variety of programs which implement the functions of the printer 1000. The operating system 502 provides functions mainly for resource management of the ROM 207, RAM 208, and HDD 209 serving as memories of the printer 1000, and basic input/output control of various devices.

A data transmission/reception program 503 controls transmission/reception processing performed upon receiving a data input/output request via the external I/F 202. More specifically, the data transmission/reception program 503 includes a protocol stack such as TCP/IP, and controls communication of various kinds of data exchanged with an external device or the like connected via a network. A device management function program 504 is executed when the system starts and when the state of a connected device changes and the control unit 205 is notified of the change. More specifically, the device management function program 504 performs comprehensive management for the connection states, statuses, performance, and the like of various devices for implementing the functions of the multi-functional peripheral by the printer 1000. These devices are detachable devices such as the printer unit 203, scanner unit 201, and sheet processing device 200, or undetachable devices. The device management function program 504 also controls opening/closing of the feeding source, the sheet conveyance path for switching a sheet to be fed, and the like.

A copy function program 505 executes the copy function. A scan function program 506 executes the scan function. A PDL print function program 507 executes the PDL print function upon receiving PDL job data via the external I/F 202. A BOX function program 508 executes the BOX function. For each function controlled by the control unit 205, the operations of various devices are sequentially controlled based on the processing order and processing conditions of the resources in the printer 1000 that are described in the BOX function program 508. These devices include the scanner unit 201, printer unit 203, sheet processing device 200, HDD 209, compression/decompression unit 210, and RAM 208.

A UI control program 509 is a control program for the touch panel portion 401 and key input portion 402 of the operation unit 204. The UI control program 509 identifies contents input by the user of the printer 1000 via the operation unit 204, performs a proper screen transition, and requests processing of the control unit 205. Other control programs 511 are used to implement functions other than those provided by the above-described programs.

<Display Screen>

Figure 6:
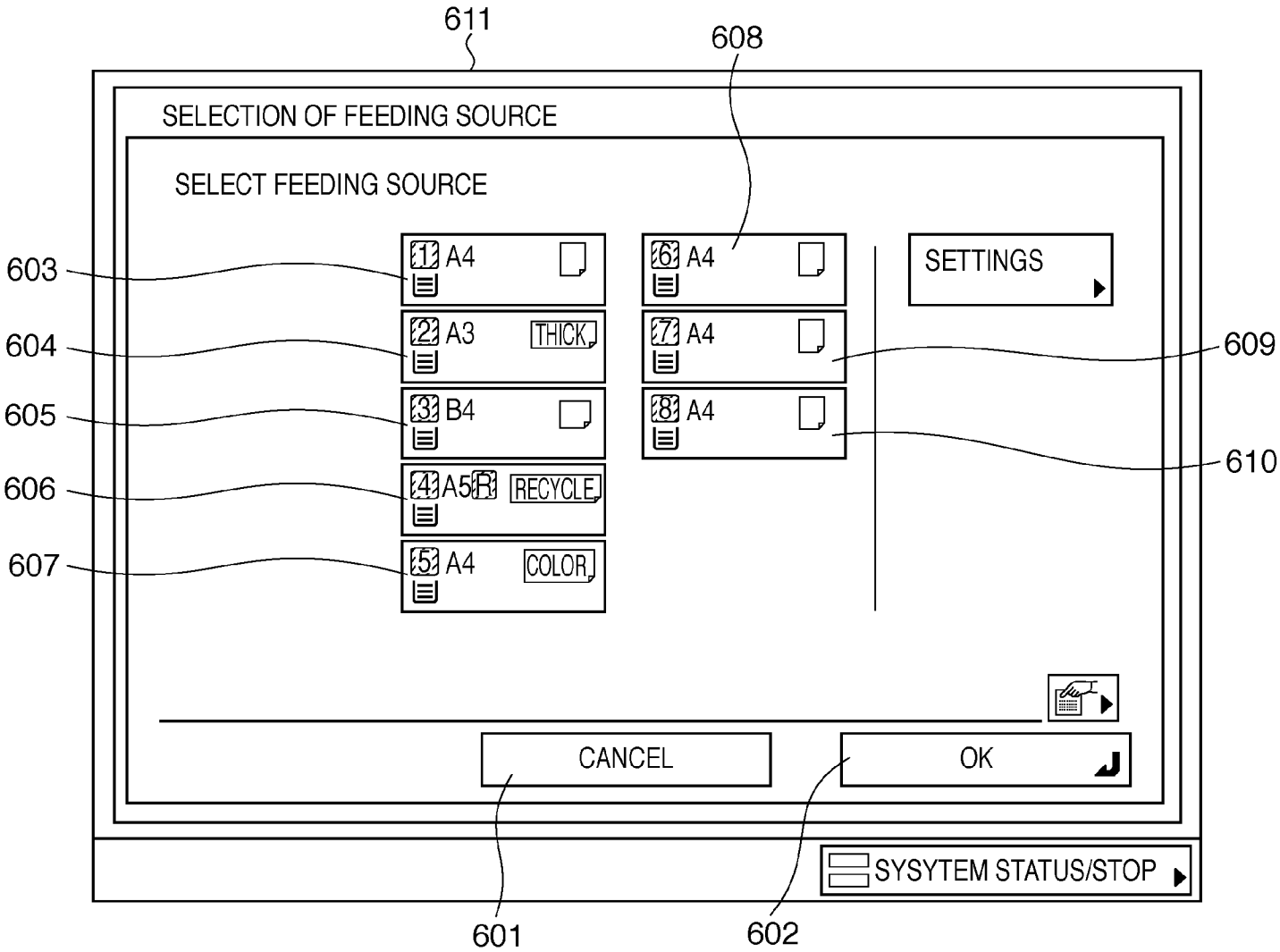
FIG. 6 is a view exemplifying a display screen displayed on the operation unit 204 according to the first embodiment.

A display screen displayed on the operation unit 204 in the first embodiment will be explained with reference to FIG. 6. The following display screen appears on the operation unit 204 when the user supplies sheets and the control unit 205 detects closing of the door of the feeding source while the printer 1000 executes print processing (image formation processing). FIG. 6 is a view exemplifying a display screen displayed on the operation unit 204 according to the first embodiment.

As shown in FIG. 6, a display screen 611 displays pieces of information such as the feeding sources of the printer 1000 and the sizes and types of sheets stacked on the respective feeding sources. More specifically, the display screen 611 displays buttons 603 to 610 configured to allow the user to select any one of the feeding sources or sheets. These buttons also display feeding sources supplied with sheets by the user during execution of print processing. Among these buttons, a button corresponding to a feeding source supplied with sheets by the user during execution of print processing may be displayed to become more conspicuous than other buttons (for example, by coloring) and identify the button. Among these buttons, a button corresponding to a feeding source used during execution of print processing may not be displayed. Also, among these buttons, a button corresponding to a feeding source used during execution of print processing may be displayed not to be able to select the button (for example, by grayout).

When the user presses a cancel button 601, the control unit 205 stops the display of the display screen 611 and changes the display screen 611 to a screen displayed before the display screen 611. Hence, when the user presses the cancel button 601, sheets used in a job during execution of print processing are not changed. That is, sheets used in print processing before the completion of supplying sheets by the user are kept used.

To the contrary, if the user presses an OK button 602, the control unit 205 changes sheets used in print processing to those on a feeding source selected via the display screen 611. At an appropriate timing after the OK button 602 is pressed, sheets used in an active job are changed to selected ones, and subsequent print processing continues. Details of the sheet switching timing will be described later. When the OK button 602 is pressed, the operation unit 204 displays a screen displayed before the display screen 611, similar to a case in which the cancel button 601 is pressed.

According to the embodiment, a screen transition to the display screen 611 need not always be determined depending on whether the user has supplied sheets. For example, the display screen 611 may be displayed at the timing when the control unit 205 detects closing of the door of the feeding source, regardless of whether sheets are actually supplied. Also in this case, the function of changing sheets used for print processing by selecting a feeding source is effective.

<Control Sequence>

Figure 7:
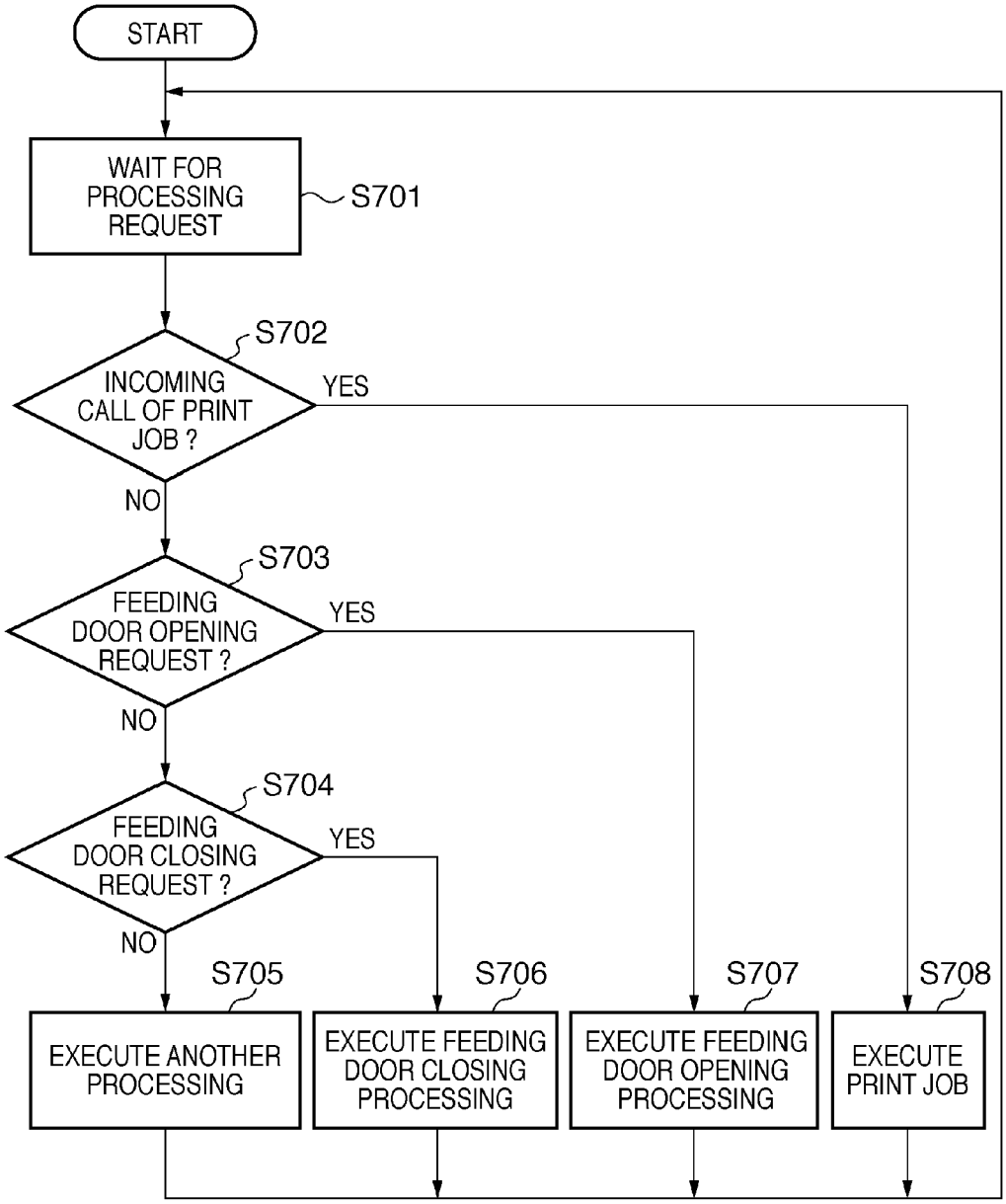
FIG. 7 is a flowchart showing the processing sequence of basic control of a printer 1000 according to the first embodiment.

A control sequence in the embodiment will be explained with reference to FIGS. 7 to 10. FIG. 7 is a flowchart showing the processing sequence of basic control of the printer 1000 according to the first embodiment. The control unit 205 comprehensively controls the following processes. The control unit 205 reads out various programs shown in FIG. 5 and executes these processes.

When the system is normally activated, the control unit 205 shifts to step S701 to wait for a processing request. When a processing request is issued, the control unit 205 shifts to processing of determining the contents of the processing request in step S702 and subsequent steps.

In step S702, the control unit 205 determines whether the issued processing request indicates the incoming call of a print job. The incoming call of a print job means that the control unit 205 detects the incoming call of job data from an external device via the external I/F 202 to execute a print job.

If the incoming call of the print job is detected, the process advances to step S708, and the control unit 205 designates execution of the print job using the received job data. In step S708, the print job is executed by reading out and executing the PDL print function program 507 in FIG. 5. The print job operation continues until all print processes based on the received job data and print settings accompanying the job data are completed. However, the processing contents in step S708 are not applied to all processes from the start to completion of the print job, but correspond to the start of executing the PDL print function program 507. That is, when execution of the PDL print function program 507 starts in step S708, the control unit 205 shifts the process to step S701. Upon receiving an instruction to start execution, the PDL print function program 507 runs autonomously till the completion of the whole print job.

In this manner, it is designed that the processing request recognized by the control unit 205 in step S701 designates execution of a program or module capable of executing the processing after determining the contents, and then the process waits for a request again. With this configuration, the printer 1000 in the embodiment can use the single control unit 205 to parallel-process a plurality of requests of many kinds. As for processing which is predicted to be completed within a short time, the control unit 205 may directly control it to the end regardless of the foregoing configuration.

If the control unit 205 determines in step S702 that the issued processing request is not the incoming call of a print job, it determines in step S703 whether the issued processing request is a feeding source door opening request. This processing request is issued when the control unit 205 detects pressing of the feeding source open button 304, 305, or 306.

If the issued processing request is a feeding source door opening request, the process advances to step S707, and the control unit 205 starts feeding door opening processing. The operation of this step corresponds to the start of executing the device management function program 504. Details of the operation in this step will be described later. Upon completion of instructing the device management function program 504 to start door opening processing in step S707, the process returns to step S701 again to wait for a processing request.

If the control unit 205 determines in step S703 that the issued processing request is not a feeding source door opening request, the process advances to step S704, and the control unit 205 determines whether the issued processing request is a feeding source door closing request. This processing request is issued when the control unit 205 detects closing of the door (that is, supply of sheets on the feeding source) when the feeding source which has been pulled out is pushed into an original position.

If the issued processing request is a feeding source door closing request, the process advances to step S706, and the control unit 205 starts feeding door closing processing. The operation of this step corresponds to the start of executing the device management function program 504. Details of the operation in this step will be described later. Upon completion of instructing the device management function program 504 to start door closing processing in step S706, the process returns to step S701 again to wait for a processing request. Note that the feeding door closing processing in S706 may be executed when sheets are supplied to a feeding source other than one used in print processing in progress, and not executed when sheets are supplied to a feeding source used in print processing in progress.

If the control unit 205 determines in step S704 that the issued processing request is not a feeding source door closing request, the process advances to step S705, and the control unit 205 executes processing other than the above-mentioned ones. Details of this processing are not essential to a description of the effects of the embodiment, and a description thereof will be omitted. Upon completion of the processing in step S705, the process returns to step S701 again to wait for a processing request.

Figure 8:
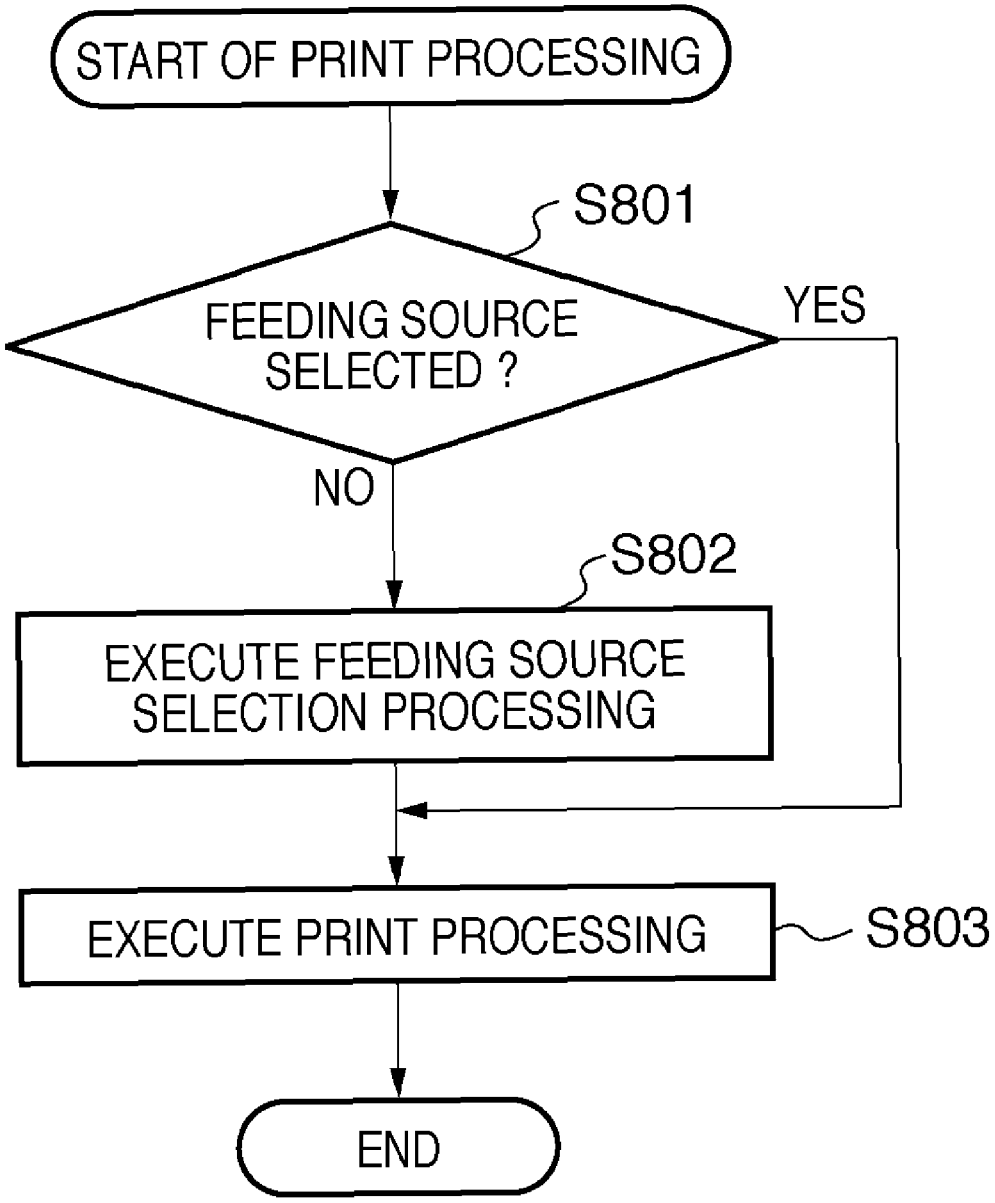
FIG. 8 is a flowchart showing the processing sequence of a print job according to the first embodiment.

The processing contents of the PDL print function program 507 in step S708 in the embodiment will be described with reference to FIG. 8. FIG. 8 is a flowchart showing the processing sequence of a print job according to the first embodiment. The control unit 205 controls the following processing by reading out and executing the PDL print function program 507.

After the start of executing a print job, the control unit 205 determines in step S801 whether a feeding source has been selected. A state in which a feeding source has been selected is a state in which job data received from the external I/F 202 contains explicit designation of the feeding destination of sheets used for the job. A state in which no feeding source has been selected is a state in which job data received from the external I/F 202 does not contain explicit designation of the feeding destination of sheets used for the job.

More specifically, the state in which no feeding source is selected in job data may be generated in the following situation. First, feeding source setting information itself is missed. Second, sheets to be fed may be designated by the type of sheet used for the job, instead of designating them by a physical position based on feeding source designation. Third, job data may contain an explicit instruction to cause a device to automatically select sheets to be fed.

In the state in which no feeding source is selected, a feeding portion needs to be specified before the start of print processing. That is, in the first case described above, the printer 1000 needs to determine sheets for use based on any criterion. For example, a feeding source is determined in accordance with a default setting. In the second case, it is necessary to specify feeding sources on which designated sheets are stacked, and determine any one of them. In the third case, a feeding source used for the job needs to be selected from a plurality of target feeding sources selectable in automatic feeding source selection.

If the control unit 205 determines that no feeding source has been selected, the process advances to step S802, and the control unit 205 selects sheets used for the print job and finalizes a feeding source for use. Then, the process advances to step S803. If the control unit 205 determines in step S801 that a feeding source has been selected, it sets sheets on the selected feeding source as those used for the print job, and the process advances to step S803. In step S803, the control unit 205 controls the printer unit 203 to execute print processing using the sheets.

The method of selecting a feeding source in step S802 changes depending on the condition under which no feeding source is selected in job data, as described above. Although a plurality of feeding source determination methods are conceivable in each state, any determination method is applicable to the present invention.

Figure 9:
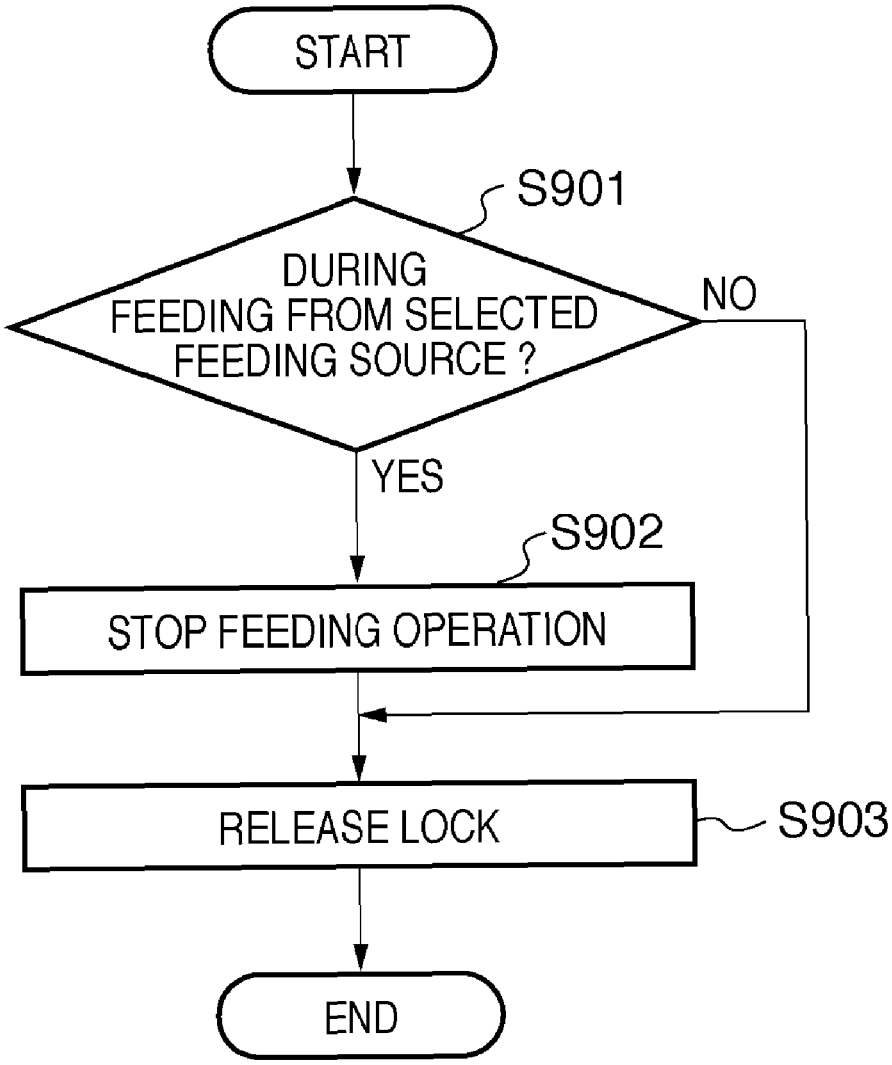
FIG. 9 is a flowchart showing the processing sequence of feeding source door opening processing according to the first embodiment.

The processing contents of the device management function program 504 in step S707 in the embodiment will be described with reference to FIG. 9. FIG. 9 is a flowchart showing the processing sequence of feeding source door opening processing according to the first embodiment. The control unit 205 controls the following processing by reading out and executing the device management function program 504. When the user presses any one of the feeding source open buttons 304, 305, and 306, the processing of this flowchart starts.

In step S901, the control unit 205 determines whether a feeding source to be opened is currently used. If the feeding source is currently used, the process advances to step S902; if it is not currently used, to step S903. In step S902, the control unit 205 stops the feeding operation from the feeding source, and the process advances to step S903. In step S903, the control unit 205 releases a lock mechanism attached not to carelessly open the feeding source.

Figure 10:
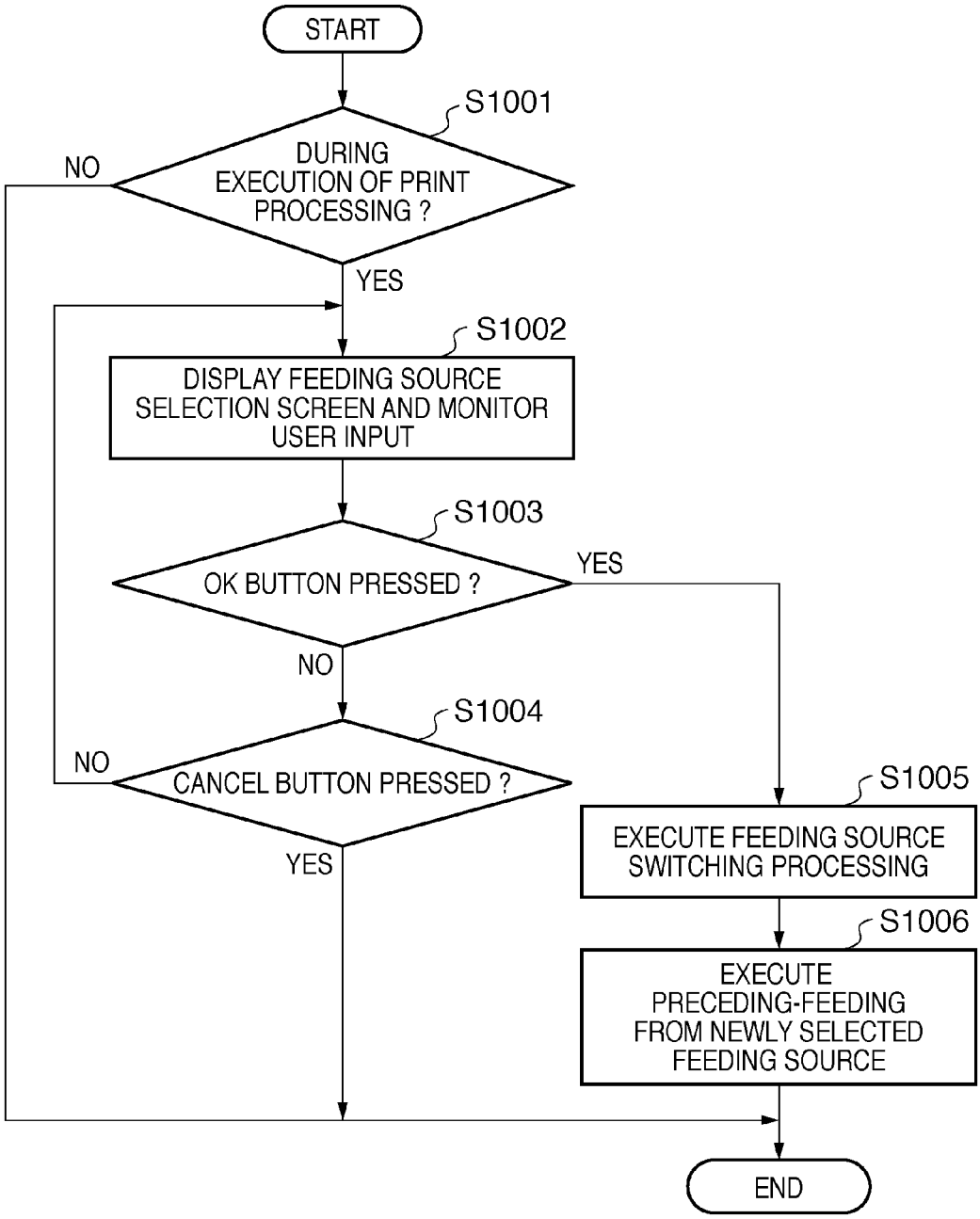
FIG. 10 is a flowchart showing the processing sequence of feeding source door closing processing according to the first embodiment.

The processing contents of the device management function program 504 in step S706 in the embodiment will be described with reference to FIG. 10. FIG. 10 is a flowchart showing the processing sequence of feeding source door closing processing according to the first embodiment. The control unit 205 controls the following processing by reading out and executing the device management function program 504. When a feeding source which has been pulled out is pushed into an original position and the control unit 205 detects the closing of the feeding source, the processing of this flowchart starts.

In step S1001, at the timing when the control unit 205 detects the closing of the feeding source, it determines whether the printer 1000 is executing print processing. If the printer 1000 is not executing print processing, the process ends; if it is executing print processing, advances to step S1002.

In step S1002, the control unit 205 displays the display screen 611 serving as a feeding source selection screen on the operation unit 204. After that, the control unit 205 monitors a user input until the user presses any one of the buttons 601 to 610 displayed on the display screen 611.

If the user presses any button, the control unit 205 determines in step S1003 whether he has pressed the OK button 602. If the control unit 205 determines that the user has pressed the OK button 602, the process advances to step S1005; if it determines that he has pressed another button, to step S1004.

In step S1004, the control unit 205 determines whether the user has pressed the cancel button 601. If the control unit 205 determines that the user has pressed the cancel button 601, it determines that the operator has stopped feeding source switching processing, and the process ends. If the control unit 205 determines that the user has not pressed the cancel button 601, it returns the process to step S1002. In this case, the user has pressed any one of the buttons 603 to 610 to select a feeding source.

In step S1005, the control unit 205 executes switching processing to the feeding source selected via the display screen 611. In the switching processing, the following processing is executed. First, feeding processing from a feeding source used before switching is interrupted. Then, an appropriate timing to switch the feeding source to the selected one is calculated. More specifically, when sheets have already been fed from a feeding source before switching, feeding from the newly selected feeding source is suspended till the completion of the preceding sheet feeding processing. Further in the feeding source switching processing, various processes need to be performed in device control and correspond to processes in this step. For example, conveyance path switching processing corresponds to a process in this step. Next, in step S1006, the control unit 205 starts feeding from the feeding source newly selected on the display screen 611 at the switching timing calculated in step S1005.

As described above, the printing system according to the first embodiment includes a plurality of feeding devices (feeding sources). When opening/closing of the feeding device is detected and image formation now proceeds, a selection screen appears to prompt the operator to select a feeding device for use in subsequent image formation. When the operator supplies sheets, the printing system can execute image formation in compliance with, for example, a request to continue image formation using the supplied sheets.

The present invention is not limited to the above-described embodiment and can be variously modified. For example, in the first embodiment, a selection screen for a plurality of feeding units is displayed in step S1002. Alternatively, print processing may continue using a feeding source supplied with sheets by the user during execution of print processing, without displaying the selection screen. At this time, a confirmation screen may be displayed to confirm with the user whether to continue print processing using the feeding source supplied with sheets by him during execution of print processing. If "YES" is selected on the confirmation screen, print processing continues using the feeding source supplied with sheets. If "NO" is selected on the confirmation screen, print processing continues using the feeding source used during execution of printing. Even when the selection screen is displayed, the printing system may execute image formation using a currently used feeding device until the operator inputs an instruction via the selection screen. The feeding device can therefore be switched according to a user need without decreasing the productivity.

When sheets are supplied to a feeding source and are different in type or size from those used now, it may be controlled not to display the selection screen. If it is determined in step S1003 that the user has pressed the OK button 602, and print processing which proceeded in step S1001 has already ended, the process may end without advancing to step S1004. At this time, the selection screen displayed in step S1002 automatically disappears. In the first embodiment, the display screen 611 is displayed and an input via it is monitored in steps S1002 to S1004. However, when the user does not perform an input operation till the lapse of a predetermined period, the control unit 205 may control to continue image formation with the currently used feeding source. At this time, the selection screen displayed in step S1002 automatically disappears. Hence, when the user supplies sheets and does not want to use the supplied sheets, image formation can continue without requiring a user operation.

<Second Embodiment>

The second embodiment will be described with reference to FIG. 11. In the first embodiment, when feeding source door closing processing is generated during execution of print processing, a feeding source selection screen is output to the operation unit 204 to change the feeding source even during execution of print processing. However, in the second embodiment, it is controlled whether to output a display screen 611 in accordance with a feeding source having undergone door closing processing in order to further increase the user work efficiency.

As shown in FIG. 3, each of large-volume feeding devices 103 and 104 includes both normal- and large-volume feeding sources different in sheet stacking volume. For example, if the display screen 611 appears every time the user opens and closes any one of feeding sources during printing, this may rather complicate the manipulation. This is because the user may use normal- and large-volume feeding sources in the large-volume feeding devices 103 and 104 to definitely discriminate the types of internally loaded sheets. A possible problem will be exemplified.

When generating complicated output materials, a bundle of all sheets of a copy may be formed from many different types of sheets. For example, thick paper sheets serving as front and back covers, slip sheets used at breaks between chapters, or sheets different from those of the body may be used. In this way, a single job may use different types of sheets, so a plurality of feeding sources are necessary to separately load the different types of sheets. In general, many types of sheets are required for use as a cover and slip sheet other than the body, but the consumption of such sheets is smaller than that of the body. For this reason, a printing system 101 includes a plurality of feeding sources (normal-volume feeding source, that is, normal-volume stacking unit, and large-volume feeding source, that is, large-volume stacking unit) different in stacking capacity.

Considering the above-mentioned use form, it is desirable for operation efficiency to load sheets used as the body in the large-volume feeding source and sheets other than those used as the body in the normal-volume feeding source. In a case in which sheets need to be supplied during execution of a job, it is expected that sheets are most frequently supplied to a feeding source loaded with sheets used as the body. In contrast, the consumption of sheets used as a cover and slip sheet is relatively small, and sheets different in type may be loaded in a plurality of normal-volume feeding sources and used.

In view of this use form, according to the second embodiment, the display screen 611 appears only when it is predicted that the user will change the feeding source upon outputting the display screen 611, instead of outputting the display screen 611 every time the door of a feeding source is closed. In other cases, output of the display screen 611 is suppressed. The user can therefore efficiently perform a feeding source selection operation after supplying sheets. Detailed processing will be explained.

Figure 11:
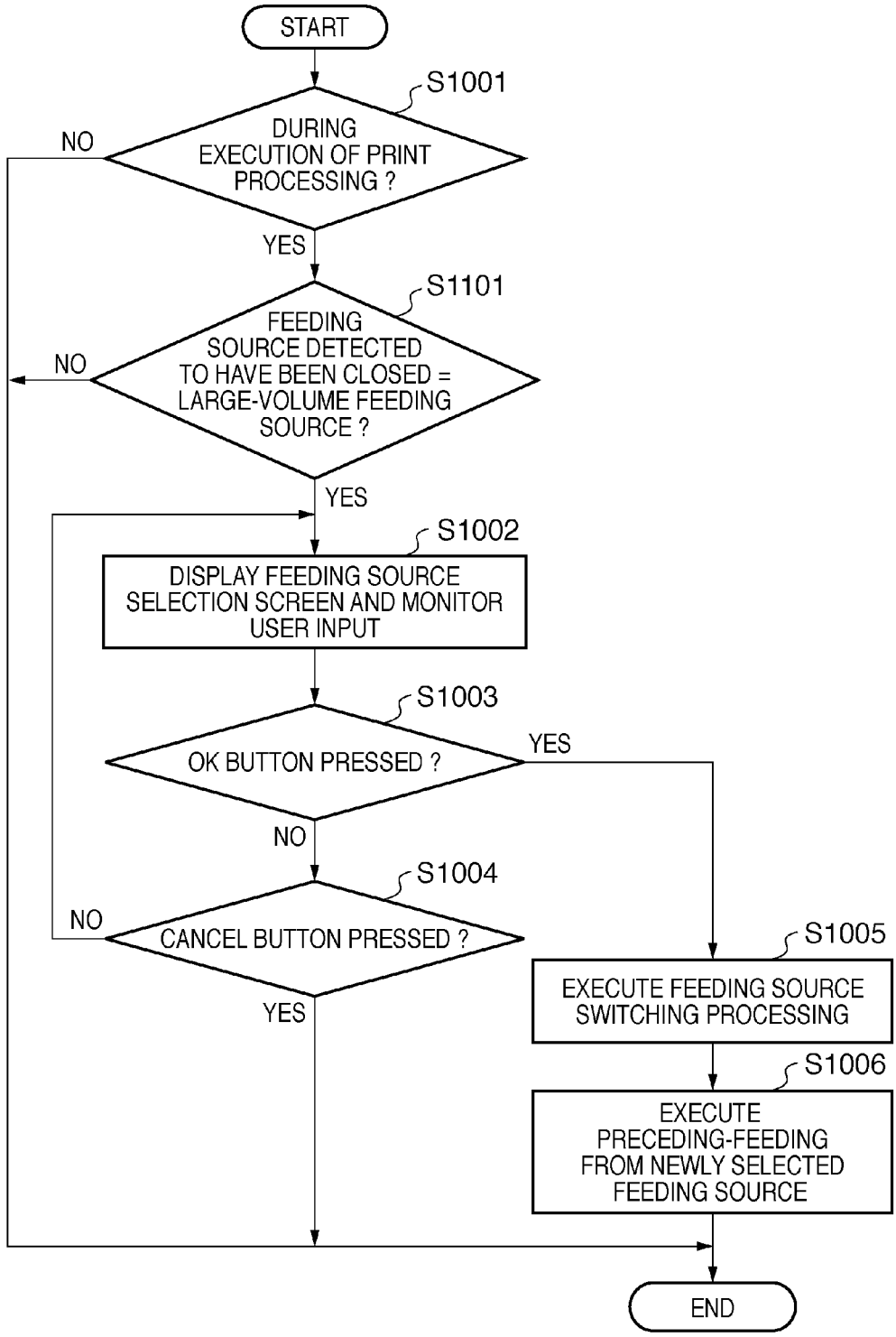
FIG. 11 is a flowchart showing the processing sequence of feeding source door closing processing according to the second embodiment.

FIG. 11 is a flowchart showing the processing sequence of feeding source door closing processing according to the second embodiment. A control unit 205 controls the following processing by reading out and executing a device management function program 504. When a feeding source which has been pulled out is pushed into an original position and the control unit 205 detects the closing of the feeding source, the processing of this flowchart starts. Note that only processes different from those in the flowchart of FIG. 10 will be explained. The same reference numerals as those in the flowchart of FIG. 10 denote the same processes in the flowchart of FIG. 11, and a description thereof will not be repeated.

If it is determined in step S1001 that print processing is in progress, the process advances to step S1101, and the control unit 205 determines whether a feeding source, closing of the door of which has been detected, is a large-volume feeding source. If the feeding source is a large-volume feeding source (YES in step S1001), the process advances to step S1002; if NO, ends. In the second embodiment, when closing of a door is detected and the door is that of a normal-volume feeding source, the process ends on the assumption that even if an operation unit 204 displays the display screen 611, the user will press a cancel button 601.

Also, when sheets are supplied to a large-volume feeding source and are different in type or size from those used now in ongoing image formation, the operation unit 204 may not display the display screen 611. This is because it is predicted that the user will not want to switch the feeding source even upon displaying the display screen 611.

As described above, the printing system according to the second embodiment includes, as feeding devices, large- and normal-volume feeding sources different in sheet stacking volume. Only when sheets are supplied to the large-volume feeding source, the display unit displays a selection screen for prompting the operator to select a feeding device. The operator need not input a feeding device via the selection screen every time he supplies sheets. The selection screen appears only when it is predicted to switch the feeding device. Thus, the second embodiment can provide an efficient user manipulation system.

Note that the present invention is not limited to the above-described embodiment and can be variously modified. For example, it may be controlled not to display the selection screen when sheets are supplied to a large-volume feeding source and are different in type or size from those used now. The present invention can therefore implement control which further meets user needs.

<Third Embodiment>

The third embodiment will be described with reference to FIG. 12. The third embodiment concerns the timing to switch the feeding source after closing of a door is detected and a feeding source to be switched is selected via a display screen 611.

The following case is assumed as a case to which the third embodiment is applied. For example, when the user supplies sheets and then requests switching to a feeding source on which the supplied sheets are stacked, the sheet type may change before and after switching. This may occur when the stock of sheets used as the body runs out and generation of output materials is more important than the coincidence of the sheet type. In this case, it is desirable to avoid, as much as possible, coexistence of different sheets in printed materials of one copy among those of a plurality of output copies. In this case, a printer 1000 according to the third embodiment switches the feeding source at a break between copies during image formation. The break between copies means a break between respective copies when a running job requests printing of a plurality of copies. Detailed processing will be explained.

Figure 12:
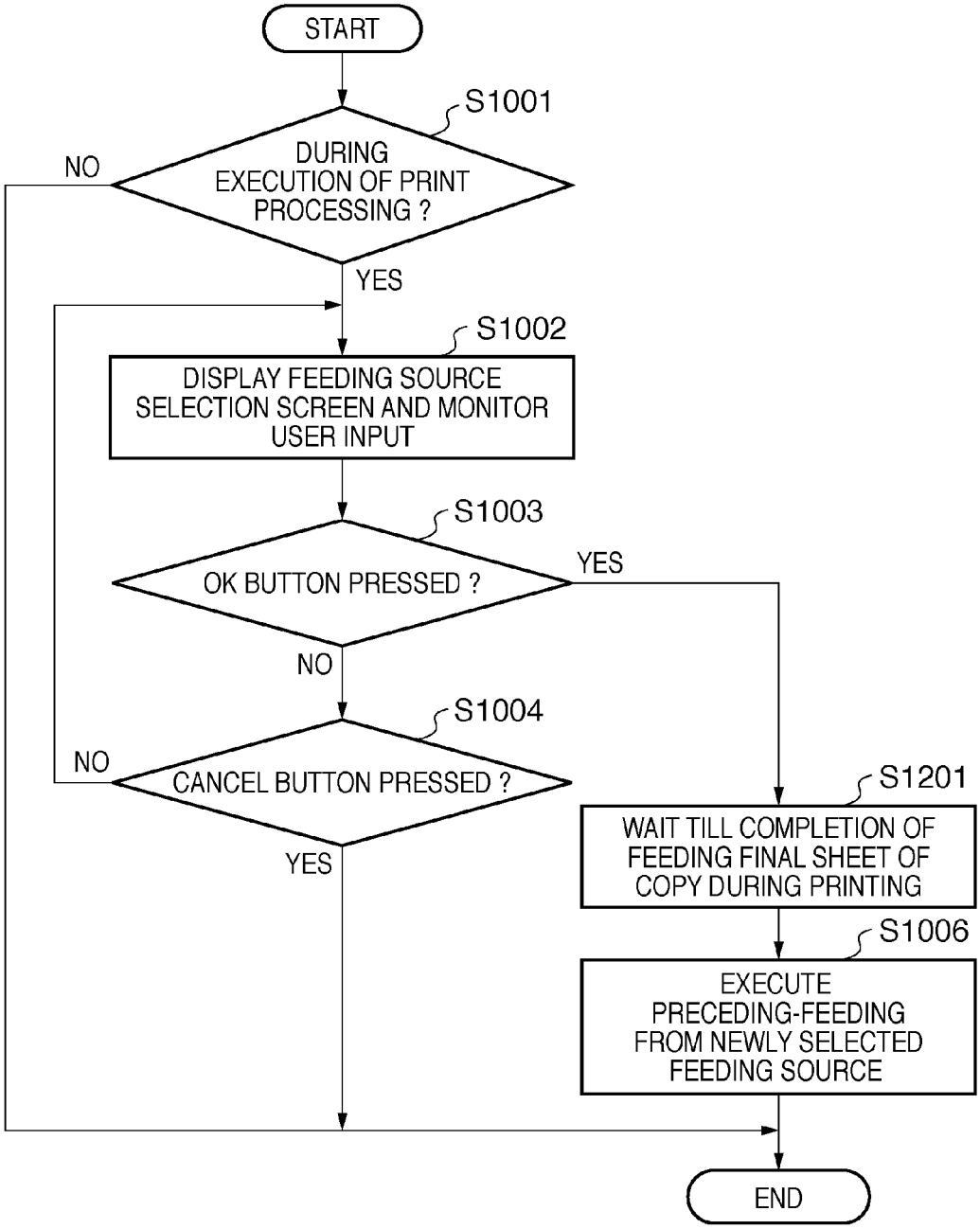
FIG. 12 is a flowchart showing the processing sequence of feeding source door closing processing according to the third embodiment.

FIG. 12 is a flowchart showing the processing sequence of feeding source door closing processing according to the third embodiment. A control unit 205 controls the following processing by reading out and executing a device management function program 504. When a feeding source which has been pulled out is pushed into an original position and the control unit 205 detects the closing of the feeding source, the processing of this flowchart starts. Note that only processes different from those in the flowchart of FIG. 10 will be explained. The same reference numerals as those in the flowchart of FIG. 10 denote the same processes in the flowchart of FIG. 12, and a description thereof will not be repeated. More specifically, only processing in step S1201 corresponding to step S1005 of FIG. 10 will be explained. The following processing may be applied to the flowchart of FIG. 11 described in the second embodiment.

If it is determined in step S1003 that the user has pressed an OK button 602, the control unit 205 waits till the break of a copy during print processing in step S1201. In other words, the control unit 205 waits till the completion of feeding the final sheet of one copy of output materials during execution of print processing. Upon completion of feeding the final sheet, the control unit 205 shifts the process to step S1006 to start feeding sheets from the newly selected feeding source.

As described above, when the operator supplies sheets and then requests switching to a feeding device, the printing system according to the third embodiment switches to the requested feeding device at the break of a copy during processing. More specifically, when the operator requests switching to a feeding device, the printing system executes switching to the requested feeding device after feeding the final sheet of a copy during processing. This can suppress coexistence of sheets of different types in a copy of printed materials.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-125847 filed on May 25, 2009, which is hereby incorporated by reference herein in its entirety.

What is claimed is:

1. A print control apparatus which controls a printing unit to execute print processing using sheets fed from at least one of a plurality of feeding units including a first feeding unit and a second feeding unit, comprising:

a detect unit configured to detect a movement which reflects that a feeding unit has been refilled;

a display unit configured to display, when the detect unit detects the movement of the refilled second feeding unit to a feeding position has occurred while the printing unit executes print processing using sheets fed from the first feeding unit, a selection screen for selecting, by a user, a feeding unit from among the plurality of feeding units; and a control unit configured to control the printing unit to continue the print processing by using sheets fed from a feeding unit selected by the user via the selection screen.

2. The apparatus according to claim 1, wherein the display unit displays the selection screen so that the user can distinguish the second feeding unit from the other feeding units.

3. The apparatus according to claim 1, wherein when a type and size of sheets supplied to the second feeding unit coincide with a type and size of sheets fed from the first feeding unit, the display unit displays the selection screen.

4. The apparatus according to claim 1, wherein when the print processing executed by using the sheets fed from the first feeding unit ends after the display unit displays the selection screen, the control unit controls the display unit to delete the selection screen.

5. The apparatus according to claim 1, wherein when the second feeding unit is not selected even after a predetermined period elapses upon displaying the selection screen on the display unit, the control unit controls the printing unit to continue the print processing executed by using the sheets fed from the first feeding unit, by using sheets fed from the first feeding unit.

6. The apparatus according to claim 1, wherein the plurality of feeding units include a large-volume stacking unit on which a large volume of sheets are fed, and a normal-volume feeding unit being smaller in feeding volume than the large-volume feeding unit, and when sheets have been supplied to the large-volume feeding unit, the display unit displays the selection screen.

7. The apparatus according to claim 1, wherein when the second feeding unit is selected, the control unit controls the printing unit to continue the print processing executed by using the sheets fed from the first feeding unit, by using sheets fed from the second feeding unit for a copy next to a copy undergoing the print processing.

8. A method of controlling a print control apparatus which controls a printing unit to execute print processing using sheets fed from at least one of a plurality of feeding units including a first feeding unit and a second feeding unit, the method comprising:

detecting a movement which reflects that a feeding unit has been refilled;

displaying, when the detection step detects that the movement which reflects that the second feeding unit is refilled has occurred while the printing unit executes print processing using sheets fed from the first feeding unit, a selection screen for selecting, by a user, a feeding unit from among the plurality of feeding units; and causing a control unit to control, the printing unit to continue the print processing, by using sheets fed from a second feeding unit selected by the user via the selection screen.

9. The apparatus according to claim 1, wherein the movement is closing a door of the feeding unit.

10. A print control apparatus which controls a printing unit to execute print processing using sheets fed from at least one of a plurality of feeding units including a first feeding unit and a second feeding unit, comprising:

a detect unit configured to detect a movement which reflects that a feeding unit has been refilled;

a control unit configured to control, when the detect unit detects the movement of the refilled second feeding unit to a feeding position has occurred while the printing unit executes print processing using sheets fed from the first feeding unit, the printing unit to continue the print processing by using sheets fed from the second feeding unit.

11. The apparatus according to claim 10, further comprising a display unit configured to display a confirmation screen for user's confirming whether the printing unit may continue the print processing by using sheets fed from the second feeding unit or not.

12. The apparatus according to claim 10, wherein the movement is closing a door of the feeding unit.

13. A method of controlling a print control apparatus which controls a printing unit to execute print processing using sheets fed from at least one of a plurality of feeding units including a first feeding unit and a second feeding unit, comprising:

detecting a movement which reflects that a feeding unit has been refilled;

controlling, when the detection step detects that the movement which reflects that the second feeding unit is refilled has occurred while the printing unit executes print processing using sheets fed from the first feeding unit, the printing unit to continue the print processing by using sheets fed from the second feeding unit.

* * * * *